US005372315A

United States Patent [19]

Kranz et al.

[11] Patent Number: 5,372,315

[45] Date of Patent: Dec. 13, 1994

[54] METHOD AND SYSTEM FOR THE PRESSURE TREATMENT OF GRANULAR MATERIAL

[75] Inventors: Peter Kranz, Neukrichen-Seelscheid; Siegfried Strasser, Much, both of Germany

[73] Assignee: Kloeckner-Humboldt-Deutz AG, Cologne, Germany

[21] Appl. No.: 100,927

[22] Filed: Aug. 3, 1993

[30] Foreign Application Priority Data

Aug. 7, 1992 [DE] Germany ..... 4226158

[51] Int. Cl.[5] ..... B02C 25/00; B02G 4/32

[52] U.S. Cl. ..... 241/30; 241/34; 241/37

[58] Field of Search ..... 241/30, 33, 34, 37, 241/230, 231, 35, 36

[56] References Cited

U.S. PATENT DOCUMENTS

| | | | |
|---|---|---|---|
| 2,905,396 | 9/1959 | Fye | 241/37 |
| 3,010,663 | 11/1961 | Bosshard | 241/37 X |
| 3,292,869 | 12/1966 | Beyeler | 241/37 |
| 3,445,070 | 5/1969 | Verdier | 241/37 |
| 3,468,488 | 9/1969 | Karrer et al. | 241/37 X |
| 3,509,815 | 5/1970 | Lloyd | 241/37 X |
| 3,901,635 | 8/1975 | Greenberger . | |
| 4,357,287 | 11/1982 | Schönert . | |
| 4,592,512 | 6/1986 | Grigel et al. . | |
| 4,635,861 | 1/1987 | Resch | 241/37 |
| 4,651,933 | 3/1987 | Schutte et al. . | |
| 4,703,897 | 11/1987 | Beisner et al. . | |
| 4,726,531 | 2/1988 | Strasser . | |
| 4,728,044 | 2/1988 | Duill et al. . | |
| 4,838,494 | 6/1989 | Jakobs . | |
| 4,840,315 | 6/1989 | Rubin et al. . | |
| 4,973,001 | 11/1990 | Kästingschäfur et al. | 241/37 |
| 5,005,775 | 4/1991 | Jakobs et al. . | |
| 5,114,131 | 5/1992 | Strasser et al. . | |
| 5,165,613 | 11/1992 | Keller . | |

FOREIGN PATENT DOCUMENTS

| | | |
|---|---|---|
| 0084383 | 6/1986 | European Pat. Off. . |
| 597775 | 6/1934 | Germany . |
| 664622 | 8/1938 | Germany . |
| 1029277 | 4/1958 | Germany . |
| 1584752 | 1/1970 | Germany . |
| 3535406 | 4/1987 | Germany . |
| 3815002 | 11/1989 | Germany . |
| 3922638 | 1/1991 | Germany . |
| 620840 | 12/1980 | Switzerland . |
| 1192732 | 5/1970 | United Kingdom . |
| 1243828 | 8/1971 | United Kingdom . |
| 2142446 | 1/1985 | United Kingdom . |

*Primary Examiner*—Timothy V. Eley
*Attorney, Agent, or Firm*—Hill, Steadman & Simpson

[57] ABSTRACT

A high pressure roller press for interparticle crushing of material including opposed crushing rollers with at least one roller being movable, a gate controlled material feed to the nip of the rollers, means measuring the nip width by measuring the distance between bearings of the rollers, means measuring the nip force by measuring the hydraulic pressure applied to the movable roller to obtain nip force, a comparator receiving signals of nip width and nip force and having an output to maintain a linear relationship between nip width and nip force and controlling the feed to the nip and the nip width to maintain the relationship.

16 Claims, 2 Drawing Sheets

METHOD AND SYSTEM FOR THE PRESSURE TREATMENT OF GRANULAR MATERIAL

BACKGROUND THE INVENTION

The invention relates to improvements in roller presses and particularly to high pressure roller presses capable of interparticle crushing.

In the development of roller presses, a unique improvement in the crushing of pulverulent material is disclosed in U.S. Pat. No. 4,357,287, Schoenert. Utilization of the interparticle crushing concept is disclosed in such patents as Beisner et al U.S. Pat. No. 4,703,897. A feature of this concept is that new and unforeseen results are attained in the utilization of unusually high nip pressures, as described in the aforementioned patents and comminution in accordance with this method creates incipient cracks in the particles so that the comminution is completed by breaking up the resultant scabs that are produced and such breaking up is accomplished with relatively low energy requirements. This new procedure has presented operational and functional problems not present in ordinary roller mill grinding and the present invention relates to a solution of certain of the problems and a discovery of an apparatus and a method of control of a roller press to obtain improved pressing with greater uniformity and uniform and improved energy consumption.

In a two roller machine of the type referred to, two oppositely driven rollers are separated from each other by a nip and at least one is constructed as a movable roller supported on pillow blocks. A force is applied to those pillow blocks by hydraulic cylinders and pistons. The hydraulic cylinders and pistons are part of a hydro-pneumatic system to apply pressing power to the rollers and include pressure boosting and pressure relieving valves to control the hydraulic fluid for the nip force. The arrangement also includes sensors for measuring the hydraulic fluid to thereby obtain a measurement of the nip force. The arrangement also contains measuring means for measuring the distance between the supporting pillow blocks at the ends of the rollers which will afford a measurement of nip width. A product delivery stack is arranged above the nip and contains a metering gate for controlling the feed of pulverulent material to the nip.

The two roller press with the pressing between them receives granular or pulverulent solid material which is subject to a pressure stressing in the nip. In one form, one of the two rollers is usually fashioned as a fixed roller which is supported directly against an end wall of the machine frame. The other roller is a movable roller supported at its end on movable pillow blocks against which the hydraulic cylinders of a hydro-pneumatic system apply force to obtain the nip force.

In a roller press of this type, shown for example in European Patent 0 084 383, individual particles of grinding stock are drawn into the nip by friction and are mutually crushed in a product bed. That is, material is compressed between the roller surfaces at an extremely high pressure to operate in accordance with interparticle crushing- This high pressure leads to partial product particle destruction in the grinding stock and creates incipient cracks in the insides of the particles. The particles are formed as agglomerates, called scabs, that are deagglomerated or disintegrated with a relatively small energy outlay.

In order to obtain optimum pressure stressing of the granular material, it is highly desirable to maintain operational parameters uniform. For example, the parameters are the force or roller pressing power in the nip and the nip width, and once these have been set at an optimum relationship, they should be maintained as constant as possible. Variations of the nip width that occur will be as a result of modifications of the charging stock. For example, modification of the input granulation can result in nip width. German Published Application 35 35 406 proposes a variation in the quantity of input stock for controlling the nip width and regulation in the material delivery can also be accomplished by a change in the height of the material column that loads the rollers at the intake of the nip which will influence the draw-in behavior of the nip.

One disadvantage of this operating arrangement is that where a constant roller pressing power and a constant nip width is used, the two roller machine cannot react to changes in material circulations that occur when the press is connected to additional machines such as a sifter, a classifier, or a ball mill.

It is accordingly an object of the present invention to create an improved two roller press and method of operating which makes it possible that optimum pressure stressing is always guaranteed even with substantial fluctuations of throughput or draw-in behavior of the nip and with fluctuations of the nip width resulting therefrom.

A further object of the invention is to provide an improved apparatus and method wherein nip force and nip width are continually measured and are maintained in predetermined relationship, preferably as a linear relationship.

A still further object of the invention is to provide an improved roller press and method of operating wherein improved more uniform interparticle crushing is obtained and ensured by continual control of the operating parameters of the press.

FEATURES OF THE INVENTION

For an optimum pressure stressing of the granular material, particularly to obtain interparticle crushing, a defined roller pressing power is required for a defined nip width. It is generally valid that an increased roller pressing power is required with increasing nip width. That is, nip width and roller pressing power are linked to one another according to the equation, roller pressing power=f (nip width), given an optimum pressure stressing.

Nip width and roller pressing power are monitored by sensors and the values obtained are compared to a prescribed equation in a monitoring and control unit. Given deviations from this equation, a control operation will result. This control operation functions to position the stock metering gates that control the feed of stock to the press nip. This will effect a change in the amount of charge offered to the two roller machine and as a result thereof nip width changes and roller pressing power changes occur. As a result of the change in nip width and thus the throughput change, the values will be varied so that the pressing power again corresponds to the other factors in accordance with the values of the prescribed equation.

In this way, the two roller machine can always be optimally matched to changes of the charging stock and changes of the throughput without the concern that there will be a reduction in the pressure stressing and the quality of the pressing.

Other objects, advantages and features will become more apparent in connection with the teaching of the principles of the invention in the disclosure of the preferred embodiments in the specification, claims and drawings, in which:

DESCRIPTION OF THE PREFERRED EMBODIMENTS

Figure 1:
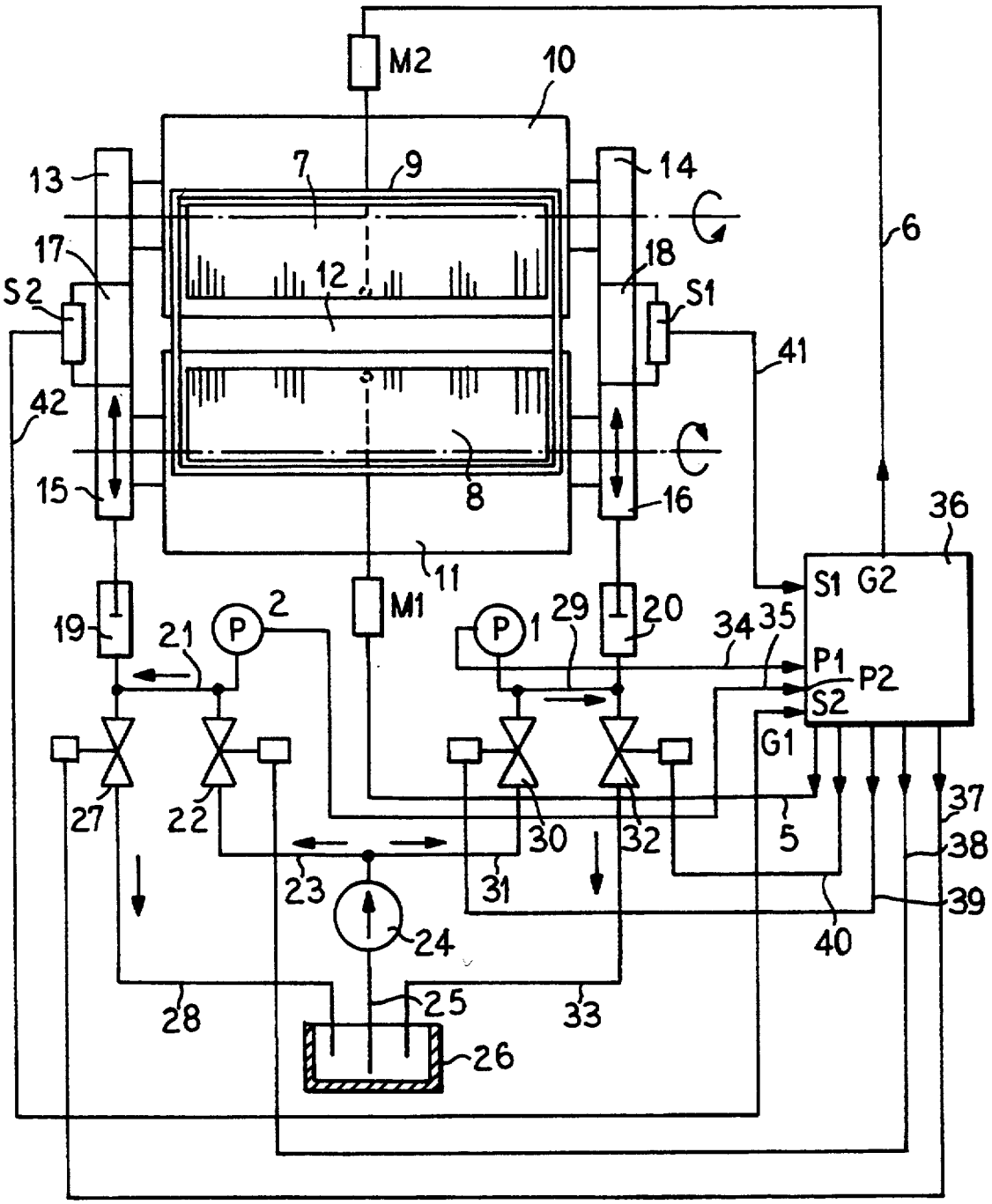
FIG. 1 is a diagrammatic or schematic showing of an overall arrangement for a two roll press with the operating and control circuitries shown.

FIG. 1 shows in plan view a two roller machine having a hydraulic means for supporting a movable roller in combination with a monitoring control of the nip width and of the roller pressing power. It will be understood that the arrangement is shown schematically so that size relationship is not accurately portrayed.

The roller press particularly for interparticle crushing of granular material comprises two oppositely rotatable rollers 10 and 11 forming a nip 12 between them. The roller 10 is a fixed roller supported on fixed bearing blocks and the roller 11 is a movable roller for controlling the nip width and force.

A product delivery stack 9 is positioned above the nip having rotationally arranged metering gates 7 that can be varied in position with operation of motors M2 and M1 and these are situated above the nip 12. The fixed roller 10 with its supporting pillow blocks 13 and 14 is supported directly at an end wall of the machine frame. The movable roller 11 is supported in pillow blocks 15 and 16 that are carried on smooth slide bars 17 and 18 of the machine frame so that they can be moved translationally as indicated by the double arrowed lines. The pillow blocks 15 and 16 of the movable roller 11 are supported by hydraulic cylinders and pistons 19 and 20 which apply the roller pressing power.

The hydraulic cylinder 19 is in communication via a line 21 with a pressure intensifying valve 22 and a line 23 leads to an oil pump 24. The pump is connected by a line 25 with an oil collecting tank 26. The hydraulic cylinder 19 is also connected to the oil collecting tank 26 through a pressure relieving valve 27 and a line 28.

A similarly connected arrangement is provided with the hydraulic cylinder 20 which is in communication via a line 29 with a pressure intensifying valve 30, and a line 31 leads to the oil pump 24. This is connected to an oil collecting tank 26 via a pressure relieving valve 32 and a line 33. The oil pump 24 pumps adequate hydraulic fluid into the hydraulic cylinders 19 and 20 via the pressure intensifying valves 22 and 30 so that the desired and necessary roller pressing power can be obtained. This pressing power is prescribed by the equation which will be illustrated in connection with FIG. 2. This corresponds to a rated pressure value to be maintained in both cylinders which is measured by gauges P1 and P2 and is connected to the outputs of a monitoring and control unit 36 via corresponding signal lines 34 and 35.

The four hydraulic fluid valves 27, 22, 30 and 32 are in communication via corresponding control lines 37, 38, 39, and 40 with corresponding outputs of the monitoring and control unit 36.

The spacing of the pillow blocks 14 and 16 is measured by a sensor S1 and the spacing of the pillow blocks 13 and 15 is measured by a sensor S2. The measuring of the spacing of the pillow blocks is representative of the width of the nip 12 at both ends of the rollers. The sensors S1 and S2 are connected via signal lines 41 and 42 to corresponding inputs of the monitoring and control unit 36.

The spacing of the pillow blocks occurring during operation and thus the width of the nip 12 occurring during operation are measured either continuously or chronologically at both roller ends by the sensors S1 and S2 and the obtained values are compared in the monitoring and control means 36 to the values of the prescribed equation. Deviations from the measured values of this equation will result in a control operation of the pressure in the hydraulic cylinder and/or a control operation of the motor operators M1 and M2 of the metering gates. The metering gates will result in a variation from the product delivery stock and the motor operators M1 and M2 are connected via signal lines 5 and 6 to the outputs G1 and G2 of the central monitoring and control unit 36. It is preferred that the control of the roller mechanism be obtained by both control of the feed gates and the nip force applied via the cylinders, but in certain circumstances control of either one separately may occur.

Figure 2:
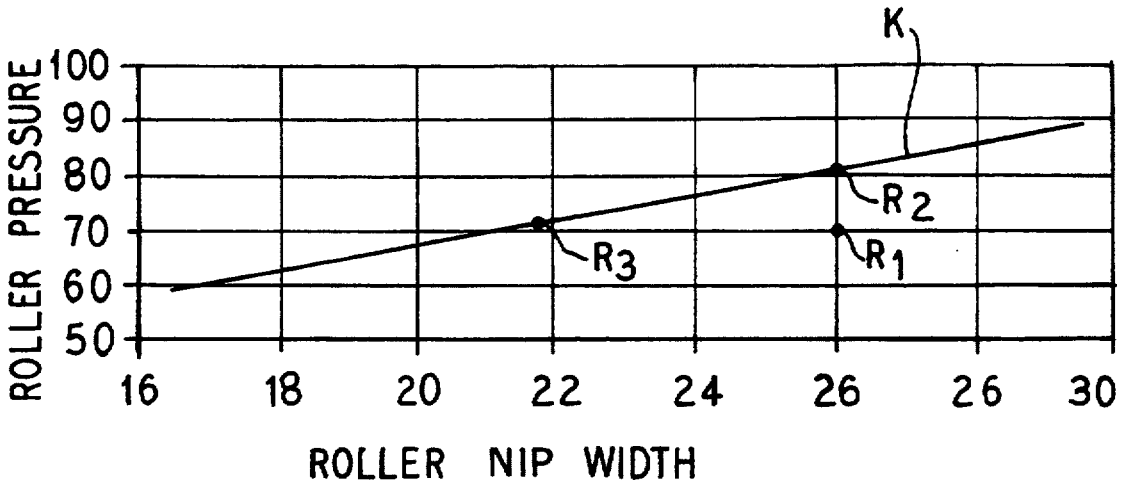
FIG. 2 is a graphic illustration of the relationship between roller press nip force and nip width.

FIG. 2 illustrates the relationship between the roller pressing power in the nip as determined by tests which attain the optimum pressure stressing and is linear in relationship. This linear relationship is shown by the straight line K.

When for example, the sensors S1, S2 measure a nip width of 26 mm, and the pressure sensors P1 and P2 measure a roller pressing power of 70 bar, then the point R1 in the diagram of FIG. 2 lies below the value of the equation of the straight line K. The straight line K is calculated for optimum pressure treatment for interparticle crushing. That is, the roller pressing power of 70 bar is too low for the nip width of 26 mm.

To obtain appropriate control operation, either the pressure must be boosted to the value R2 of 80 bar that corresponds to the straight line K or, if this is not possible due to the draw-in conditions of the material when the throughput is to be lowered, the nip width is reduced by throttling the feed amount with the metering gates 7 and 8 until the value R3 of approximately 22 mm is attained that corresponds to the roller pressing bar pressing power of 70 bar. It is also possible to implement a simultaneous control of the metering gates 7 and 8 and the roller pressing power to thus shift the point R2 to an arbitrary point on the straight line K.

Thus, it will be seen that by following the optimum relationship between roller width and roller pressure, this will result in an optimum crushing operation. To ensure that this relationship will always be maintained even with variations in conditions which occur because of the nature of the material being handled, continual and substantially instantaneous regulation of the operation of the apparatus is ensured. Continual measurement of nip width and nip press is attained and compared and when variations occur, by automatic control of the feed gate and nip pressure, optimum nip width for essentially perfect interparticle crushing is assured. This automatic operation is far superior to that which would be attained by a manual operator attempting to make operating compensations for change in material feed.

Thus, it will be seen there has been provided an improved method and apparatus for particle crushing which meets the objectives and advantages above set forth and which assures uniform and optimum operation and continual machine pressing and crushing.

We claim as our invention:

1. A method for operating a high pressure roller press for the pressure comminution of granular material by interparticle crushing, the press comprising two oppositely driven rollers that are separated from one another by a nip, at least one thereof being fashioned as a movable roller carried on movable pillow blocks supported by hydraulic cylinders of a hydro-pneumatic system with which the roller pressing power is exerted, further comprising pressure increasing and relieving valves controlling the force of the hydraulic cylinders, further comprising sensors for measuring the width of the nip during operation at both ends of the movable roller, and further comprising a product delivery stack that is arranged above the nip and containing a metering gate, the method comprising:

measuring the width of the nip during operation of the two roller machine at both roller ends and measuring pressure in the hydraulic system to obtain values of nip width and pressing force;

comparing the values in a monitoring and control unit to a predetermined equation;

and controlling the position of the movable roller and nip width and the metering gate as a function of deviation from said equation until the measured values again correspond to the values of the equation.

2. A two roller machine forming a high pressure roller press for the pressure comminution of granular material by interparticle crushing, comprising in combination:

two oppositely driven rollers separated from one another by a nip with at least one roller being movable and carried on movable pillow blocks supported by hydraulic cylinders of a hydropneumatic system for exerting the roller pressing power;

pressure increasing and relieving valves controlling the force of the hydraulic cylinders;

a product delivery stack arranged above the nip and containing a metering gate;

means measuring the width of the nip during operation of the two roller machine at both roller ends and measuring the pressing force in the hydraulic system to obtain values of nip width and pressing force;

and a monitoring and control unit connected to compare the values to a predetermined equation and controlling the position of the movable roller and nip width and the metering gate as a function of deviation from said equation until the measured values again correspond to the values of the equation.

3. A method of crushing pulverulent stock in a nip between parallel crushing rollers for interparticle crushing comprising the steps:

generating a first measurement indicative of measurement of the width of the nip between the roller;

generating a second measurement indicative of the measurement of the nip pressure between the rollers;

and comparing said first and second measurement and controlling the feed of stock to the nip to effect said measurements and obtain a continual predetermined relationship between said measurement.

4. A method of crushing pulverulent stock in a nip between parallel crushing rollers for interparticle crushing in accordance with the steps of claim 3:

wherein the nip width is controlled as a function of comparing said first and second measurements to obtain a continual predetermined relationship between nip width and pressure.

5. A method of crushing pulverulent stock in a nip between parallel crushing rollers for interparticle crushing in accordance with the steps of claim 3:

wherein the feed of stock to the nip is increased or decreased as a function of measurement of increase or decrease of nip pressure.

6. A method of crushing pulverulent stock in a nip between parallel crushing rollers for interparticle crushing in accordance with the steps of claim 3:

wherein the width of the nip is controlled as a function of both of said first and second measurements.

7. A method of crushing pulverulent stock in a nip between parallel crushing rollers for interparticle crushing in accordance with the steps of claim 3:

wherein a constant linear relationship is maintained between nip width and the force in the nip.

8. A method of crushing pulverulent stock in a nip between parallel crushing rollers for interparticle crushing in accordance with the steps of claim 3:

wherein said first and second measurements are compared and both feed of material and nip width are simultaneously varied as a function of said measurements.

9. A method of crushing pulverulent stock in a nip between parallel crushing rollers for interparticle crushing in accordance with the steps of claim 3:

wherein the roller nip pressure is controlled by movement of one of the rollers as a function of said first and second measurements.

10. A method of crushing pulverulent stock in a nip between parallel crushing rollers for interparticle crushing in accordance with the steps of claim 3:

wherein a continual comparison is made to obtain continual first and second measurements and continual control of the feed to the nip and the width of the nip is maintained as a function of said first and second measurements.

11. A roller press for crushing pulverulent stock by interparticle crushing comprising in combination:

opposed parallel rollers forming a pressing nip therebetween for the high pressure interparticle crushing of pulverulent material with at least one of said rollers being movable for controlling the width of the nip;

force means to move said movable roller for controlling the nip width;

first measuring means measuring the nip width;

second measuring means measuring the pressure in the nip;

and comparing means receiving values from said first measuring means and said second measuring means and connected to said force means to move the movable roller as a function of said first and second measuring means obtaining a predetermined relationship between nip width and nip pressure.

12. A roller press for crushing pulverulent stock by interparticle crushing constructed in accordance with claim 11:

including material feed means positioned above said nip with a feed controlled gate;

and means for controlling the position of said gate to control the feed to the nip as a function of said first and second measuring means for maintaining the relationship between nip pressure and width.

13. A roller press for crushing pulverulent stock by interparticle crushing constructed in accordance with claim 11:

including a material feed above the nip with a variable gate for controlling the rate of feed;

a comparing means receiving said first and second measuring means for maintaining a continual linear relationship between nip force and nip width and controlling said gate and the nip width to maintain the constant linear relationship.

14. A roller press for crushing pulverulent stock by interparticle crushing constructed in accordance with claim 11:

wherein said force means includes an hydraulic cylinder at each end of the movable roll and said first measuring means measures the hydraulic pressure in the cylinder for measuring nip pressure.

15. A roller press for crushing pulverulent stock by interparticle crushing constructed in accordance with claim 11:

wherein said second measuring means measures the distance between support bearing at each end of both rolls to measure nip width.

16. A roller press for crushing pulverulent stock by interparticle crushing constructed in accordance with claim 11:

including a material feed with a control gate positioned above the nip for feeding stock to the nip;

and including a comparator receiving said first and second measuring means and having a predetermined control relationship maintaining said relationship between nip pressure and width and operatively connected to the gate and to the force means to maintain said relationship.

* * * * *